US008304971B2

(12) United States Patent
Huang

(10) Patent No.: US 8,304,971 B2
(45) Date of Patent: Nov. 6, 2012

(54) LED LIGHT BULB WITH A MULTIDIRECTIONAL DISTRIBUTION AND NOVEL HEAT DISSIPATING STRUCTURE

(76) Inventor: Tsung-Hsien Huang, I-Lan Hsien (TW)

( * ) Notice: Subject to any disclaimer, the term of this patent is extended or adjusted under 35 U.S.C. 154(b) by 187 days.

(21) Appl. No.: 12/987,104

(22) Filed: Jan. 8, 2011

(65) Prior Publication Data

US 2012/0176017 A1 Jul. 12, 2012

(51) Int. Cl.
*H01J 7/24* (2006.01)

(52) U.S. Cl. ..... 313/46; 313/44; 313/45; 362/273; 362/264; 362/294; 362/547

(58) Field of Classification Search ..... 313/41–46; 362/273, 264, 294, 547
See application file for complete search history.

(56) References Cited

U.S. PATENT DOCUMENTS 7,396,146 B2 * 7/2008 Wang ..... 362/294
8,227,960 B2 * 7/2012 Huang ..... 313/46

* cited by examiner

*Primary Examiner* — Tracie Y Green
(74) *Attorney, Agent, or Firm* — Pai Patent & Trademark Law Firm; Chao-Chang David Pai

(57) ABSTRACT

A light emitting diode (LED) light bulb includes a light shade, a heat conduction base, a plurality of heat sink fins, a heat conduction member and a plurality of LED light emitting elements. The heat conduction base has a circumferential portion connected with the plurality of heat sink fins and a central hole to accommodate the heat conduction member. The heat conduction member has an exposed end formed with a plurality of inclined planes and a top plane by stamping. Each of the inclined planes and the top plane are coupled with at least one of the LED light emitting elements, respectively. With the inclined planes and the top plane, the LED light emitting elements project light in different directions. The heat from the LED light emitting elements is transmitted to the plurality of heat sink fins through the heat conduction member to dissipate the heat quickly.

8 Claims, 7 Drawing Sheets

LED LIGHT BULB WITH A MULTIDIRECTIONAL DISTRIBUTION AND NOVEL HEAT DISSIPATING STRUCTURE

BACKGROUND OF THE INVENTION (a) Field of the Invention

The present invention relates to a light emitting diode (LED) light bulb and more particularly to a LED light bulb which can project multiple-direction light and dissipate heat quickly.

(b) Description of the Prior Art

A conventional LED light bulb has LED emitting elements therein. The LED emitting elements are disposed at the front end of the light bulb, so the light is centrally projected at the front end in the same direction. The peripheral light is weak and insufficient in brightness, and the illumination is not even. The LED light bulb has the advantage in saving energy, but its heat-resistance is low. It is necessary to solve this problem of heat dissipation. The LED light bulb manufactured by Philips company uses a metallic heat sink base formed by molding to dissipate the heat. However, it is heavy and expensive and the heat sink effect is limited.

Nowadays, traditional tungsten light bulbs are gradually replaced with LED light bulbs. The conventional LED light bulb dissipates the heat by using the LEDs and the conductive pins of the power source or the heat conduction of the circuit board. After a period of use, the temperature will rise so high that the LEDs will be damaged. In particular, the higher the number of the LEDs is, the higher the temperature will rise. Accordingly, the inventor of the present invention has devoted himself to solving this problem and invented the LED light bulb described in this application.

SUMMARY OF THE INVENTION

The primary object of the present invention is to provide a light emitting diode (LED) light bulb which comprises a light shade, a heat conduction base, a plurality of heat sink fins, a heat conduction member and a plurality of LED light emitting elements. The heat conduction base has a circumferential portion connected with the plurality of heat sink fins and a central hole to accommodate the heat conduction member. The heat conduction member has an exposed end formed with a plurality of inclined planes and a top plane by stamping. Each of the inclined planes and the top plane are coupled with at least one of the LED light emitting elements, respectively. By the inclined planes and the top plane at different angles, the plurality of LED light emitting elements project multiple-direction light, enhancing the brightness and illumination of the light bulb. The heat from the LED light emitting elements is transmitted to the plurality of heat sink fins through the heat conduction ember to dissipate the heat quickly, thus ensuring that the LED light emitting elements won't be damaged due to over heat.

Another object of the present invention is to provide a light emitting diode (LED) light bulb, wherein the exposed end of the heat conduction member is formed with a truncated pyramid having a plurality of inclined planes and a top plane. Each of the inclined planes and the top plane are coupled with at least one LED light emitting element respectively, providing a multiple-direction projection to enhance the brightness and illumination of the light bulb.

A further object of the present invention is to provide a light emitting diode (LED) light bulb, wherein the central hole is a through hole or a blind hole to accommodate the heat conduction member. The assembly is convenient, quick and stable.

A further object of the present invention is to provide a light emitting diode (LED) light bulb, wherein the heat conduction member is a heat conductive pipe or a copper cylinder (a copper pipe). Alternatively, the heat conduction member is integrally formed with an upper end of an aluminum heat conduction base. Thus the heat from the LED light emitting elements is transmitted to the plurality of heat sink fins through the heat conduction member to dissipate the heat quickly.

A further object of the present invention is to provide a light emitting diode (LED) light bulb, wherein the plurality of heat sink fins are tightly coupled to the circumferential portion of the heat conduction base in a welding connection or in a riveting connection. A plurality of heat sink fins are disposed around the heat conduction base to constitute the support end surface for supporting and connecting the light shade. All the heat sink fins are exposed to contact with external air, providing a better heat dissipation effect.

DETAILED DESCRIPTION OF THE PREFERRED EMBODIMENTS

Figure 1:
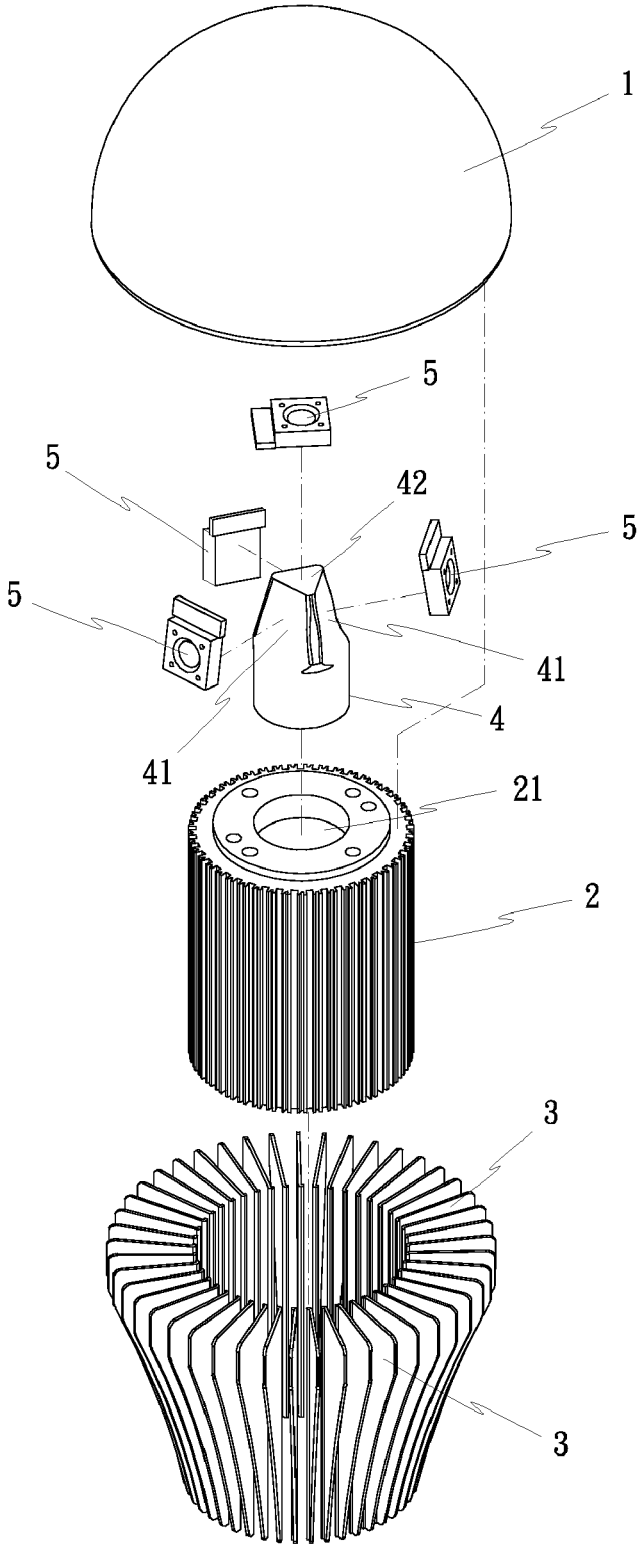
FIG. 1 is an exploded view of the LED light bulb according to the present invention.

Embodiments of the present invention will now be described, by way of example only, with reference to the accompanying drawings.

As shown in FIG. 1 to FIG. 4, a light emitting diode (LED) light bulb according to a preferred embodiment of the present invention comprises a light shade 1, a heat conduction base 2, a plurality of heat sink fins 3, a heat conduction member 4, and a plurality of LED light emitting elements 5.

Figure 2:
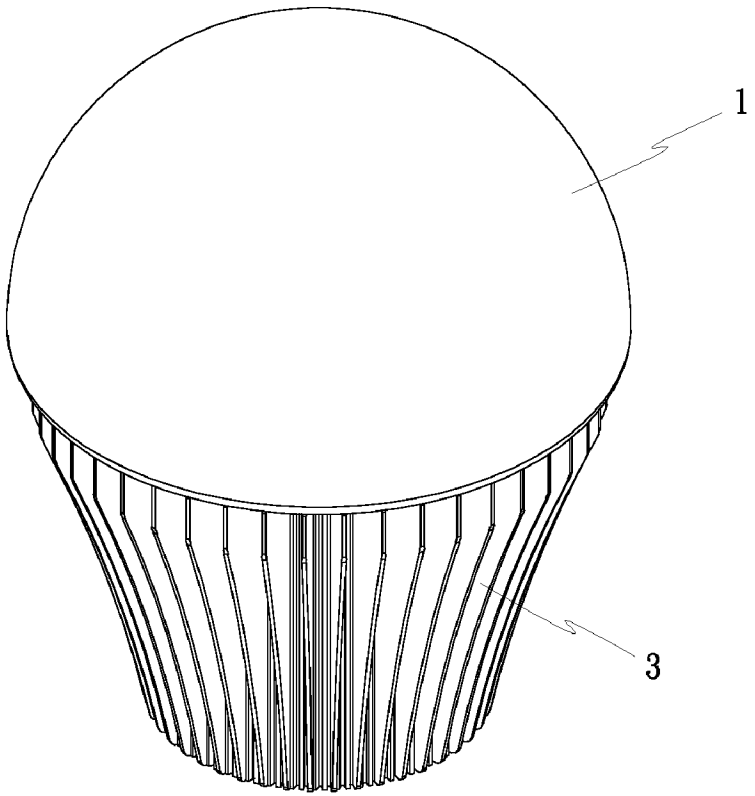
FIG. 2 is a perspective view of the LED light bulb according to the present invention.
Figure 4:
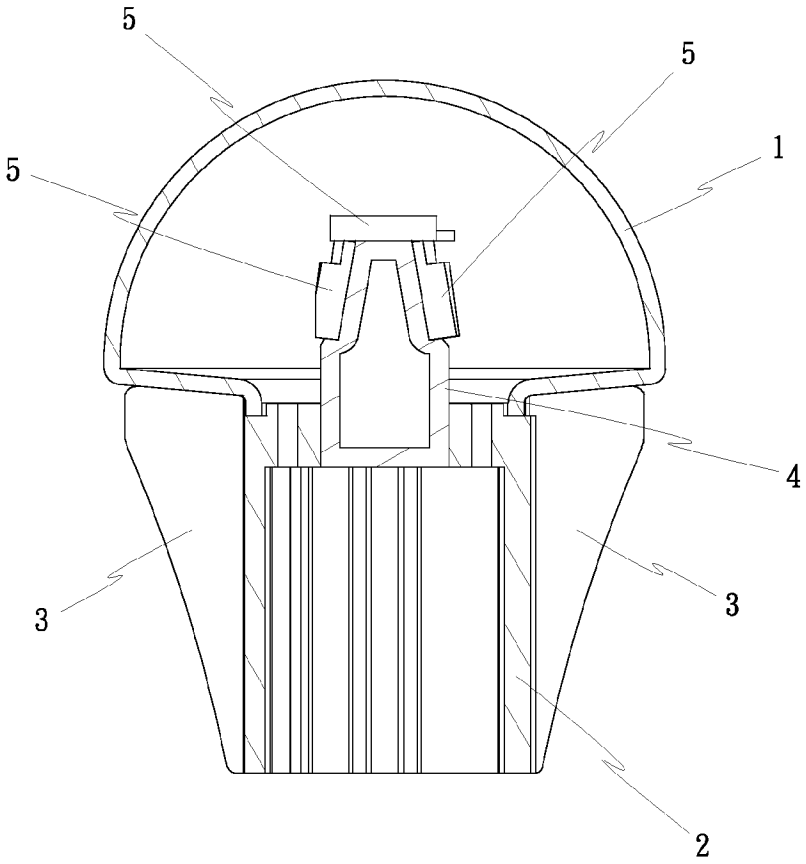
FIG. 4 is a cross-sectional view taken along line A-A in FIG. 3.

The light shade 1 is a light-pervious semi-spherical shell. The light shade 1 is coupled to be formed by the plurality of encircled heat sink fins 3 by gluing or by engagement, or other suitable means. As shown in FIG. 2 and FIG. 4, the light shade 1 is secured to the support end surface of the plurality of heat sink fins 3. The heat conduction base 2, the heat conduction member 4 and the plurality of LED light emitting elements 5 are disposed between the light shade 1 and the plurality of heat sink fins 3.

Figure 3:
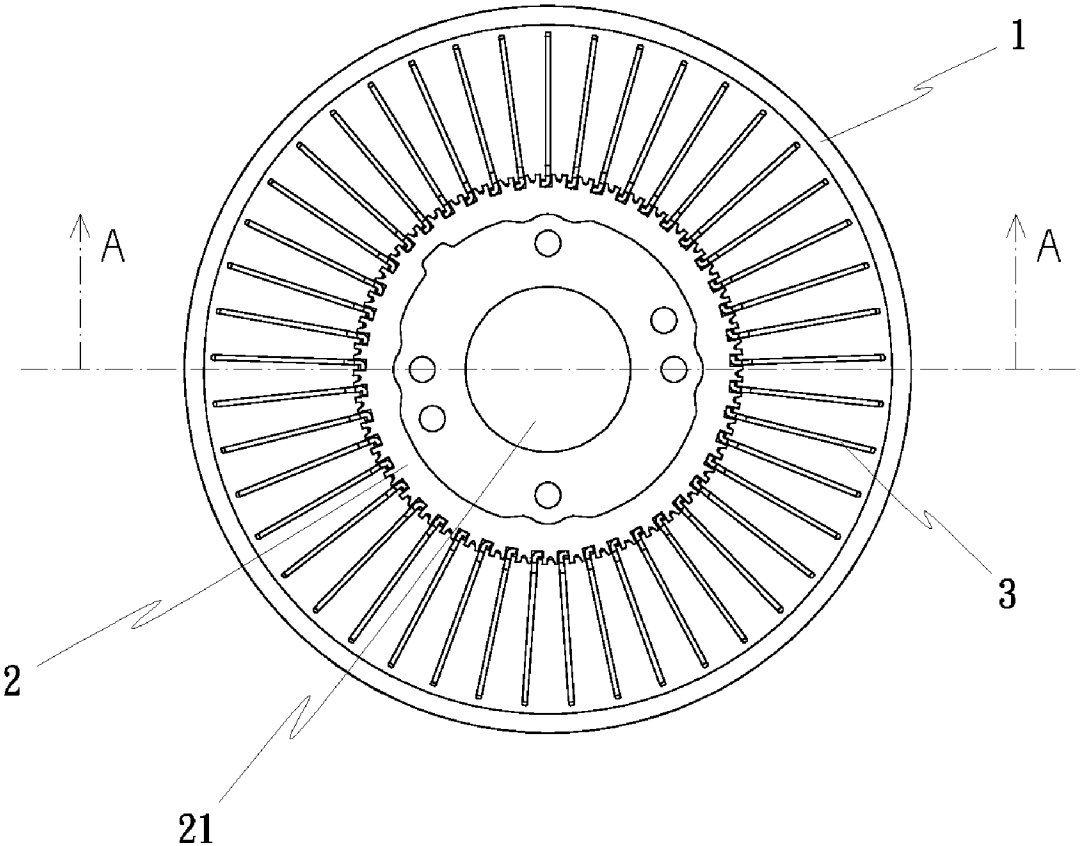
FIG. 3 is a bottom view of the LED light bulb according to the present invention.

The heat conduction base 2 has one end connected with the heat conduction member 4 and a bottom end connected with a connector (not shown in the drawings) to couple with an electric connector. The heat conduction base 2 has a circumferential portion connected with the plurality of heat sink fins 3, as shown in FIG. 3, and a central hole 21 to accommodate the heat conduction member 4. In this embodiment, the central hole 21 is a through hole, as shown in the drawings, so that the heat conduction member 4 can be mounted in the central hole 21 quickly. The central hole 21 can be a blind hole, i.e. a hole with a closed end, to mount the heat conduction member tightly.

The plurality of heat sink fins 3 are tightly coupled to the circumferential portion of the heat conduction base 2 by welding or by riveting. As shown in the drawings, the plurality of heat sink fins 3 are disposed around the heat conduction base 2 to constitute for supporting and connecting the light shade 1. All the heat sink fins 3 are exposed to contact with external air, thus providing a better heat dissipation effect.

The heat conduction member 4 can be a heat conductive pipe embedded in the central hole 21 of the heat conduction base 2. The heat conduction member 4 has an exposed end formed with a plurality of inclined planes 41 and a top plane 42 by stamping. As shown in the drawings, the exposed end of the heat conduction member 4 is formed with a triangular truncated pyramid having the plurality of inclined planes 41 and the top plane 42. Each of the inclined planes 41 and the top plane 42 are coupled with at least one LED light emitting element 5, respectively.

The plurality of LED light emitting elements 5 each are composed of a single light emitting chip or a plurality of light emitting chips. At least one of the LED light emitting elements is attached to each of the inclined planes 41 and the top plane 42 of the heat conduction member 4, respectively.

The plurality of LED light emitting elements 5 use the inclined planes 41 and the top plane 42 at different angles to project multiple-direction light, thus enhancing the brightness and illumination. The heat from the LED light emitting elements 5 is transmitted to the plurality of heat sink fins 3 through the heat conduction ember 4 to dissipate the heat quickly because the plurality of heat sink fins 3 are in contact with the external air. The plurality of LED light emitting elements 5 won't be damaged due to overheat. Therefore, the service life of the light bulb won't be shortened by high temperature.

Figure 5:
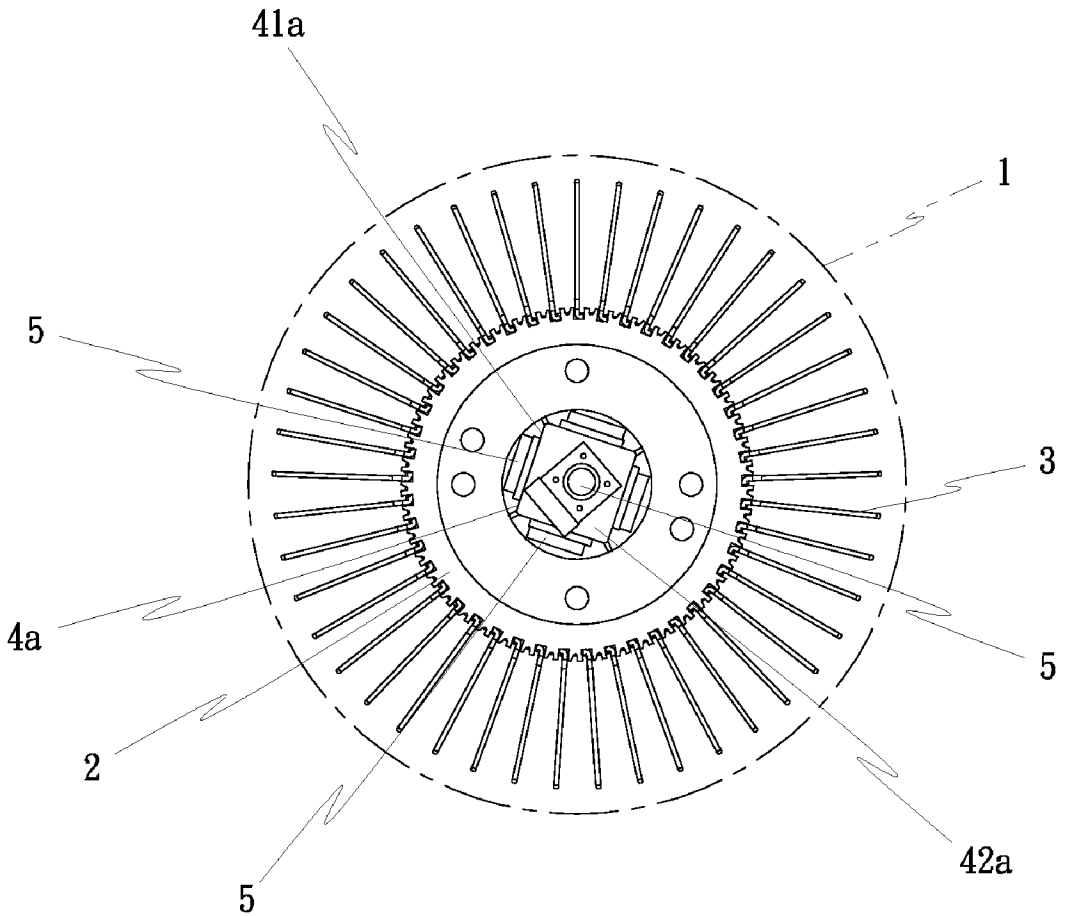
FIG. 5 is a top view of another embodiment of the LED light bulb according to the present invention.

FIG. 5 shows another embodiment of LED light bulb according to the present invention. The shape of the heat conduction member 4*a* is changed. The exposed end of the heat conduction member 4*a* is formed with a quadrilateral truncated pyramid having four inclined planes 41*a* and a top plane 42*a* by stamping. Each inclined plane 41*a* and the top plane 42*s* are respectively coupled with at least one LED light emitting element 5 to increase the brightness of the light source. The exposed end of the heat conduction member 4*a* can be formed with another polygonal truncated pyramid, such as pentagonal, hexagonal or octagonal truncated pyramid.

Furthermore, the length of the heat conduction member 4, 4*a* is proportional to the depth of the central hole 21 for the connection of the heat conduction member 4, 4*a* and the central hole 21. Preferably, the heat conduction member 4, 4*a* is tightly embedded in the central hole 21. The heat conduction member 4, 4*a* can be connected to the central hole 21 by gluing or by welding, or by other means.

As shown in the drawings, the heat conduction base 2 is a hollow base. Alternatively, the heat conduction base 2 can be a solid base. The shape of the heat conduction base 2 is not limited to a circle, instead it can be a triangle, rectangle, polygon or other geometric shape. The plurality of heat sink fins 3 corresponds in shape, size, and arrangement to those of the heat conduction base 2.

Figure 6:
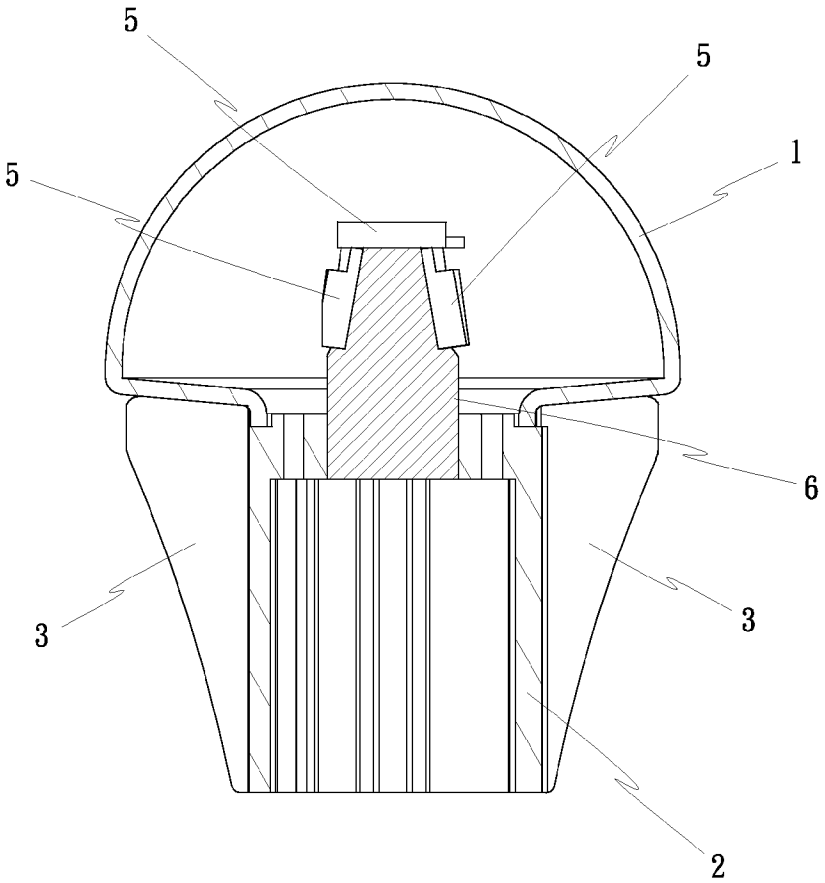
FIG. 6 is a cross-sectional view of another embodiment of the LED light bulb according to the present invention.

FIG. 6 shows a further embodiment of LED light bulb according to the present invention, which uses a copper cylinder (or a copper pipe) as the heat conduction member 6. The heat conduction member 6 is coupled to the central hole 21 of the heat conduction base 2 and has an exposed end formed with a plurality of inclined planes and a top plane. The copper cylinder can be a solid cylinder or a hollow pipe (copper pipe).

Figure 7:
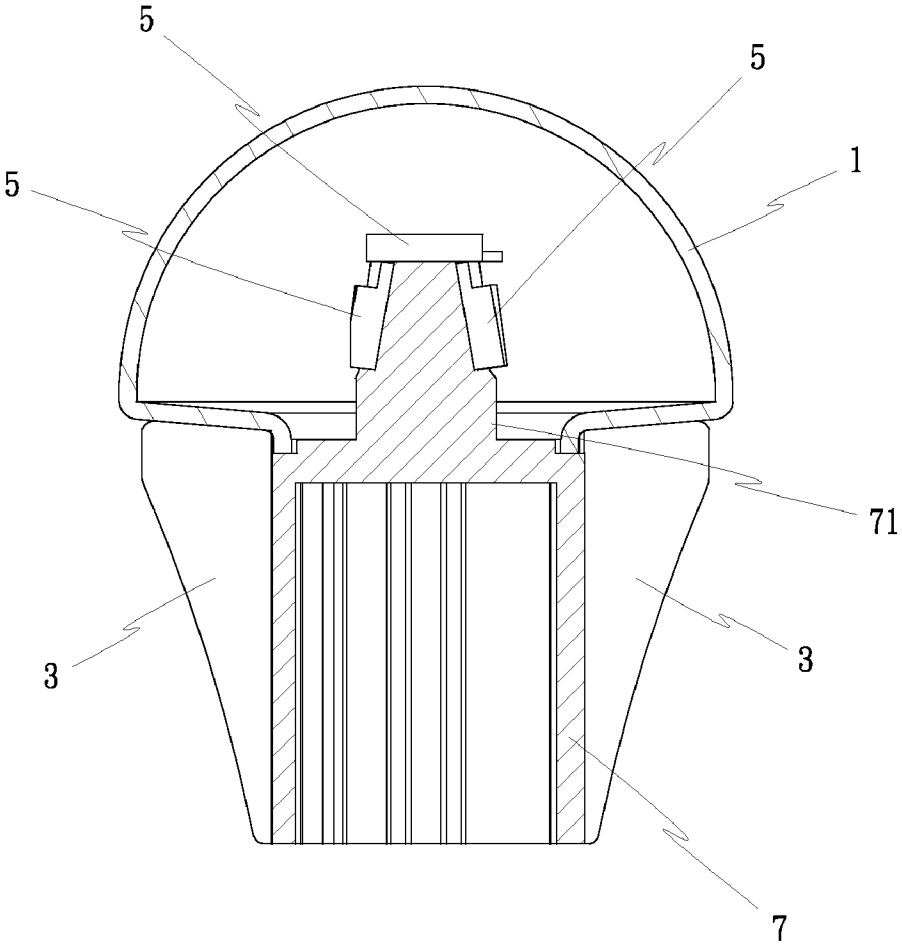
FIG. 7 is a cross-sectional view of a further embodiment of the LED light bulb according to the present invention.

As shown in FIG. 7, a heat conduction member 71 is integrally formed with an upper end of an aluminum heat conduction base 7. The heat conduction member 71 has a plurality of inclined planes and a top plane which are respectively coupled with at least one LED light emitting element. The heat from the LED light emitting elements 5 is transmitted to the plurality of heat sink fins 3 through the heat conduction member 71 to dissipate the heat quickly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A light emitting diode (LED) light bulb, comprising a light shade, a heat conduction base, a plurality of heat sink fins, a heat conduction member and a plurality of LED light emitting elements, wherein the light shade is coupled to the plurality of heat sink fins;

the heat conduction base, the heat conduction member and the plurality of LED light emitting elements are disposed between the light shade and the plurality of heat sink fins;

the heat conduction base has one end connected with the heat conduction member, a circumferential portion connected with the plurality of heat sink fins and a central hole to accommodate the heat conduction member;

the plurality of heat sink fins are coupled to the circumferential portion of the heat conduction base;

the heat conduction member is coupled in the central hole of the heat conduction base and has an exposed end formed with a plurality of inclined planes and a top plane by stamping, each of the inclined planes and the top plane being coupled with at least one of the LED light emitting elements, respectively; and each of the LED light emitting elements is composed of a single light emitting chip or a plurality of light emitting chips;

whereby, with the inclined planes and the top plane at different angles, the plurality of LED light emitting elements project light in multiple directions, and the heat from the LED light emitting elements is transmitted to the plurality of heat sink fins through the heat conduction member to be dissipated quickly.

2. The LED light bulb as claimed in claim 1, wherein the central hole of the heat conduction base is a through hole.

3. The LED light bulb as claimed in claim 1, wherein the central hole of the heat conduction base is a blind hole.

4. The LED light bulb as claimed in claim 1, wherein the exposed end of the heat conduction member is formed with a polygonal truncated pyramid having the plurality of inclined planes and the top plane.

5. The LED light bulb as claimed in claim 1, wherein the heat conduction member is tightly embedded in the central hole of the heat conduction base.

6. The LED light bulb as claimed in claim 1, wherein the heat conduction member is a heat conductive pipe.

7. The LED light bulb as claimed in claim 1, wherein the heat conduction member is a copper cylinder or a copper pipe.

8. A light emitting diode (LED) light bulb, comprising a light shade, a heat conduction base, a plurality of heat sink fins, a heat conduction member and a plurality of LED light emitting elements, wherein the light shade is coupled to the plurality of heat sink fins;

the heat conduction base, the heat conduction member and the plurality of LED light emitting elements are disposed between the light shade and the plurality of heat sink fins;

the heat conduction base is an aluminum heat conduction base, the heat conduction base having one end integrally formed with the heat conduction member and a circumferential portion connected with the plurality of heat sink fins;

the plurality of heat sink fins are coupled to the circumferential portion of the heat conduction base;

the heat conduction member is integrally formed with an upper end of the aluminum heat conduction base and has an exposed end formed with a plurality of inclined planes and a top plane, each of the inclined planes and the top plane being coupled with at least one of the LED light emitting elements, respectively; and each of the LED light emitting elements is composed of a single light emitting chip or a plurality of light emitting chips;

whereby, with the inclined planes and the top plane at different angles, the plurality of LED light emitting elements project light in multiple directions, and the heat from the LED light emitting elements is transmitted to the plurality of heat sink fins through the heat conduction member to be dissipated quickly.

* * * * *